US005842238A

United States Patent [19]

Herrick et al.

[11] Patent Number: 5,842,238

[45] Date of Patent: Dec. 1, 1998

[54] MOVABLE WASHSTAND AND ASSOCIATED FOLDING CART

[76] Inventors: Mark W. Herrick, 108 Savannah Way; Jim D. Garner, 314 W. Main St., both of Danville, Ky. 40422

[21] Appl. No.: 634,945

[22] Filed: Apr. 19, 1996

[51] Int. Cl.[6] ..... A45D 19/04

[52] U.S. Cl. ..... 4/516; 4/518

[58] Field of Search ..... 4/515, 516, 517, 4/518, 519, 522, 560.1, 592, 645

[56] References Cited

U.S. PATENT DOCUMENTS

| | | | |
|---|---|---|---|
| D. 195,396 | 6/1963 | Barkus | 4/516 X |
| 2,760,207 | 8/1956 | Glintz | 4/516 |
| 2,850,742 | 9/1958 | Glintz | 4/516 |
| 3,013,280 | 12/1961 | Coffman et al. | 4/516 |
| 3,694,826 | 10/1972 | Pugh | 4/516 |
| 3,731,325 | 5/1973 | Guarrasi | 4/519 |
| 4,081,867 | 4/1978 | Simeola | 4/516 |
| 4,512,043 | 4/1985 | Nolan | 4/516 |
| 4,660,233 | 4/1987 | Beaver | 4/516 |
| 4,834,121 | 5/1989 | Bell | 4/516 X |
| 4,998,302 | 3/1991 | Silva | 4/516 |
| 5,245,713 | 9/1993 | Tickle | 4/516 |
| 5,305,481 | 4/1994 | Nebb | 4/516 |
| 5,335,384 | 8/1994 | Foster | 5/622 |
| 5,381,562 | 1/1995 | Holloway et al. | 4/516 |
| 5,528,776 | 6/1996 | Carmichael | 4/516 |

*Primary Examiner*—Robert M. Fetsuga
*Attorney, Agent, or Firm*—R. Christian Macke

[57] ABSTRACT

A movable washstand comprises a device for supplying water having a spray nozzle, a head rest, a catch basin, drain and bladder for temporarily holding discharge water and effluent and an electrical outlet, all mounted on a C-shaped frame with wheels that allow easy portability. A dual line extension hose having an inlet line, outlet line and quick connect capabilities allow the unit to be connected to a remote sink. An on-board extension cord allows the unit to be plugged into a remote electrical supply. The base of the cart slides under a bed and out the way while the catch basin is positioned under a patient's head. The height of the catch basin is adjustable to accommodate different bed configurations. The upper and lower members of the cart are hinged so that they fold over onto themselves transforming the unit into an extremely portable unit. A self-supporting movable wash pan is also disclosed that minimizes displacement of a patient.

2 Claims, 7 Drawing Sheets

MOVABLE WASHSTAND AND ASSOCIATED FOLDING CART

TECHNICAL FIELD

This invention relates to movable washstands and a folding cart associated therewith as used in the care of elderly or bedridden patients.

BACKGROUND OF THE INVENTION

Bedridden patients in hospitals, nursing homes and even those cared for in home have the problem of not being able to freely use a sink or shower facility to wash. In many instances, injury and illness are so severe that any displacement or movement of such persons are uncomfortable and even dangerous. For the hygiene and comfort of such persons it is desirable to provide a movable washstand whereby soap and water may be applied while they remain in bed. Of course it is desirable to keep any soap and water from spilling onto the bed and sheets. It is also desirable that such a device requiring only minimal displacement of a patient, and a device that may be positioned under the patient to catch the soap and water.

One of the difficulties in providing a movable washstand that may be positioned under the patient is that any such device must be adaptable to different heights to accommodate different configurations of the beds to which the patients are restricted. It is thus desirable to provide a movable washstand that is adjustable to different bed heights.

Large facilities caring for elderly or bedridden patients, such as hospitals and nursing homes require numerous such movable washstands to be stored and maintained. It is desirable to provide a device that requires minimal storage space. It is also desirable to provide a device that is easily portable between floors of a large multi-floor facility. Furthermore, due to the increasing use of in-home care provided by health professionals, it is desirable to provide a device that is easily portable in the trunk of an automobile. That is, a device that is sufficiently lightweight and can be made compact.

The nature of the rooms in which movable washstands are used, whether in large nursing homes, hospitals, or at home, is generally small and crowded with other furniture and equipment utilized in the care of the patient. It is thus desirable to provide a movable washstand that may be utilized without occupying a lot of floor space in the room when in use, a device that does not, in effect, add another piece of large furniture or equipment to the room.

Prior art movable washstands do not solve the above problems. A patient is either required to lean off the edge of the bed to be positioned over a sink or tub, or he is required to significantly move or have moved his head or feet or other part of anatomy such that a bulky sink or tub can be positioned underneath him.

In addition, prior art movable washstands occupy a significant amount of floor space next to the bed when in use. Typically they are mounted on large carts that must sit next to the bed while in use.

Prior art movable washstands comprise, for example, a sink and waste water storage compartment mounted on castors or wheels. Mobility of those washstands is provided by rolling them from room to room. The size of prior art movable washstands has made movement up and down stairs difficult or impossible. In addition, portability by way of automobiles has not been a concern with prior art devices, and the size and weight of such devices is prohibitive of such.

Even prior art portable tables utilized in facilities treating elderly and bedridden patients are bulky and difficult to transfer between floors, similar to the prior art movable washstands discussed above. Carts having wheels and a tabletop surface, commonly used for serving food to bedridden patients, are known in the prior art. However, because of the physical dimensions of size and weight of such carts, movement between floors has been convenient only through the use of elevators. The dimensions have also necessitated large storage areas in large patient care facilities for the high number of carts maintained in such a facility when such carts are not in use.

The use of portable tables for in-home health care needs of bedridden patients makes it desirable to provide a table that is easily portable via automobile. A cart which is sufficiently lightweight and can be made compact enough to fit into a trunk is most desirable.

It is desirable to provide a cart mounted on wheels and easily mobile from room to room on the same floor that is also portable between floors and which does not require the use of elevators. It is also desirable to provide a cart that may be made compact when not in use to reduce the storage space required therefor, as well as to make such cart portable by way of automobile.

SUMMARY OF THE INVENTION

This invention addresses and overcomes the various drawbacks of prior art movable washstands. It proposes a movable washstand that is highly portable, does not occupy a lot of floor space when in use, and does not require significant displacement of the patient for use. This invention also proposes a highly portable folding cart for use in the care and treatment of elderly and bedridden patients requiring minimal storage space.

It is an object of the present invention to provide a movable washstand with a catch basin that can be positioned between a bedridden patient and the bed requiring only minimal displacement of the patient and that prevents waste water and effluent from being spilled onto the bed.

It is another object to provide a movable washstand that occupies a minimum amount of floor space next to the bed when in use.

It is yet another object to provide a movable washstand with extensions to a remote water supply and a discharge bladder for temporarily storing waste water and effluent.

It is another object of the present invention to provide a movable washstand having a frame construction that folds over onto itself to assume a compact and highly portable configuration requiring minimal storage space.

It is still another object of the present invention to provide a cart used in the care of bedridden patients that is folded over onto itself to assume a compact and highly portable configuration requiring minimal storage space.

It is another object of the present invention to provide a movable washstand having a catch basin that is positioned between a bedridden patient and the bed that is adjustable to accommodate different bed configurations.

It is yet another object of the present invention to provide a shallow self-supported movable wash pan that is positioned between a patient and the bed requiring a minimum of displacement of the patient.

DESCRIPTION OF THE PREFERRED EMBODIMENT

Figure 1:
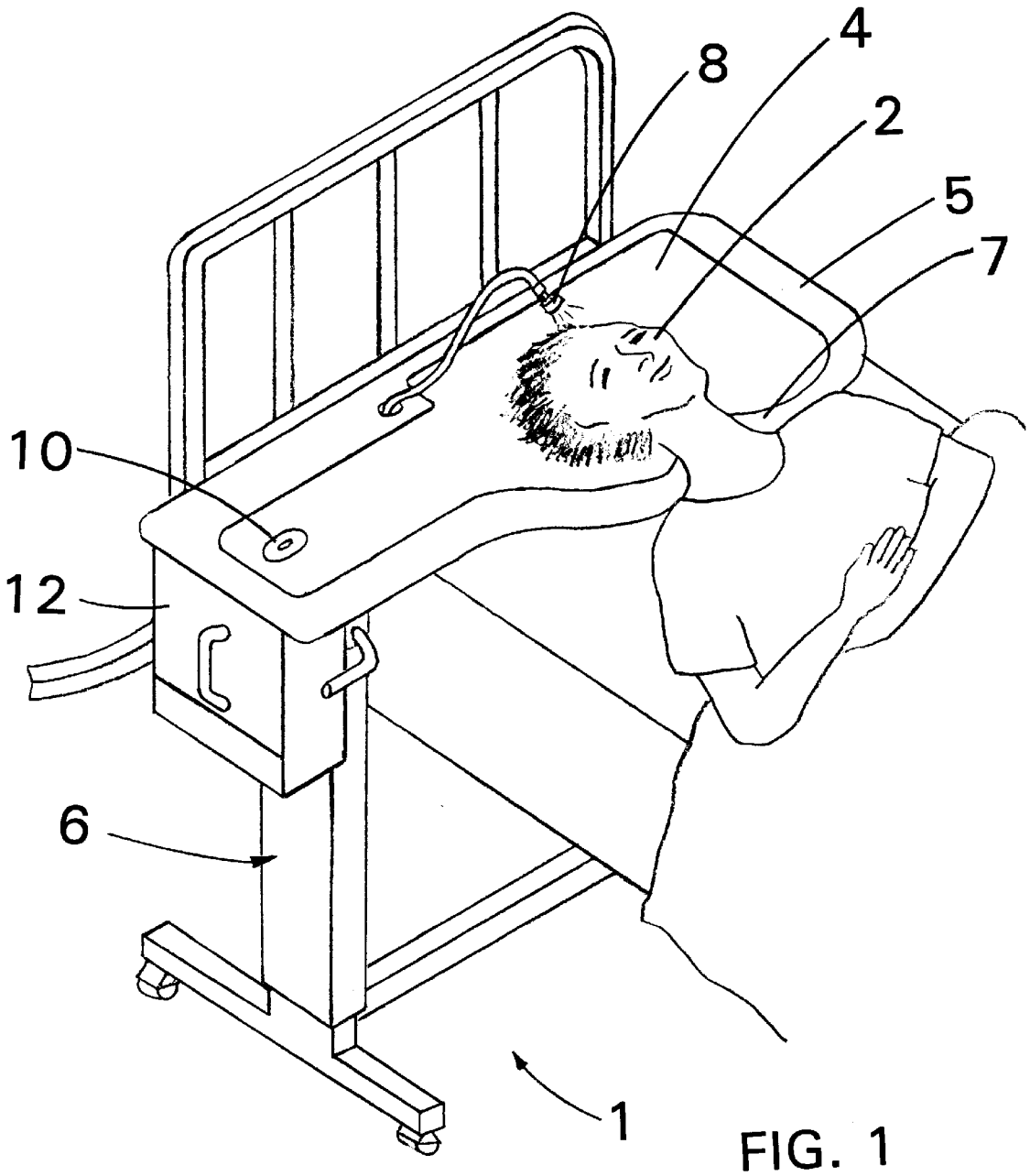
FIG. 1 is a perspective view of the movable washstand of the present invention shown as used by a bedridden patient to wash hair.

A movable washstand 1 embodying the principles of the present invention is depicted in use in FIG. 1. A bedridden patient's head 2 is placed over a catch basin 4 which is mounted on a C-frame 6. The catch basin 4 has a raised outer lip 5 that includes a depression 7 for receiving the patient's neck. Water being sprayed from a hand operated valve 8 rinses the patient's head 2 and flows to the drain 10. A bladder 12 affixed to the catch basin 4 receives waste water and effluent existing the drain 10.

Figure 2A:
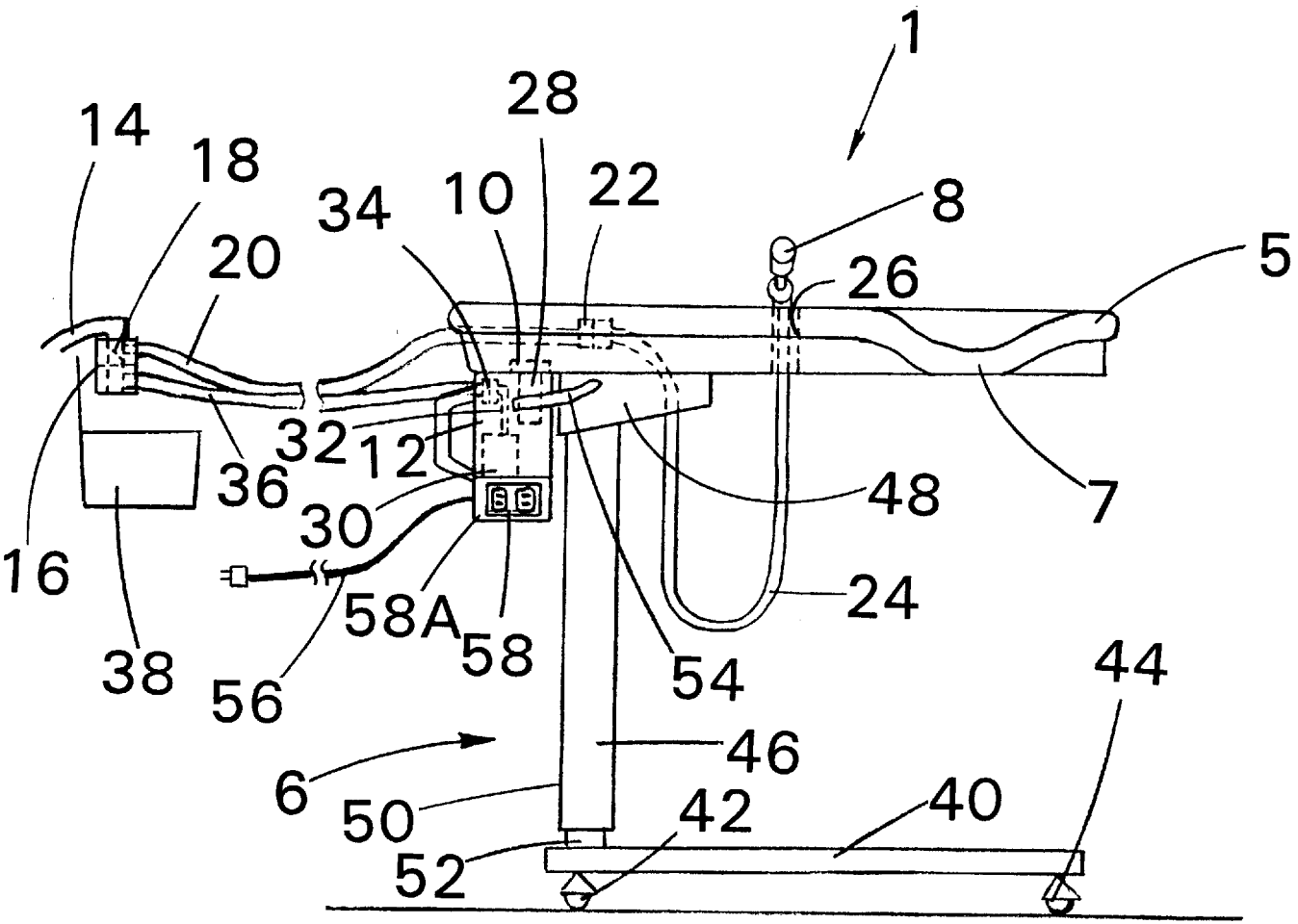
FIG. 2*a* is a side view of the movable washstand including the catch basin, C-frame cart, inlet and outlet extension hoses and electrical extension cord.

Fresh water is supplied to the hand operated valve 8 from a remote source faucet 14 (see FIG. 2*a*). A quick connect coupling 16 with an integral two way valve 18 is connected to an inlet extension hose 20 and an outlet extension hose 36. The valve 18 is shown in a pass through position in phantom in FIG. 2*a*. Water passes directly through the coupling 16 and not through inlet extension hose 20 when the valve 18 is so positioned.

The inlet extension hose 20 extends to the movable washstand 1 and is connected thereto at inlet coupling 22. A free hose loop 24 extends from the inlet coupling 22 to the hand operated valve 8, passing through a sleeve 26 in the lip 5. The free hose loop 24 moves freely in the sleeve 26 to allow an operator to move the valve 8 around to rinse a patient's head without requiring movement of the patient's head.

Means for evacuating waste water generated during washing is provided in the form of the catch basin 4, from which waste water flows to drain 10, where it passes through drain pipe 28. The waste water is stored in bladder 12 until a discharge means removes it. Specifically, a level detecting float (not shown) triggers pump 30 to begin pumping the waste water out through pump pipe 32, exit coupling 34 and outlet extension hose 36. The waste water is discharged through the quick connect coupling 16 and into a remote sink 38.

The movable washstand 1 depicted in FIG. 2*a* includes a C-frame 6 which has a lower horizontal member 40 which is mounted on wheels 42, 44 allowing the C-frame 6 to be freely moved about. A vertical member 46 extends upwardly from the lower horizontal member 40 and an upper horizontal member 48 is attached at the top of the vertical member 46. The vertical member 46 includes a height adjustment means comprising an outer sleeve 50 and inner post 52 on which the outer sleeve 50 slides. A locking latch (known in the prior art and not shown) between the outer sleeve 50 and inner post 52 is interiorly latched and unlatched exteriorly by latch handles 54 which are mounted at the top of top of the sleeve 50. The latch handles 54 extend outwardly a sufficient distance to preclude interference with the bladder 12. The length of vertical member 46 is adjusted thereby allowing modification of the height of the of the upper horizontal member 48 and the catch basin 4 mounted thereon to accommodate different heights The movable washstand 1 depicted in FIG. 2*a* a also includes an electrical extension cord 56 which provides electrical power from a remote location for both the pump 30 and for utility outlets 58 which are available to provide power for electric razors, hairdryers and the like. The outlets 58 are enclosed in a housing 58A that is affixed to and electrically isolated from the bottom of the bladder 12.

Figure 2B:
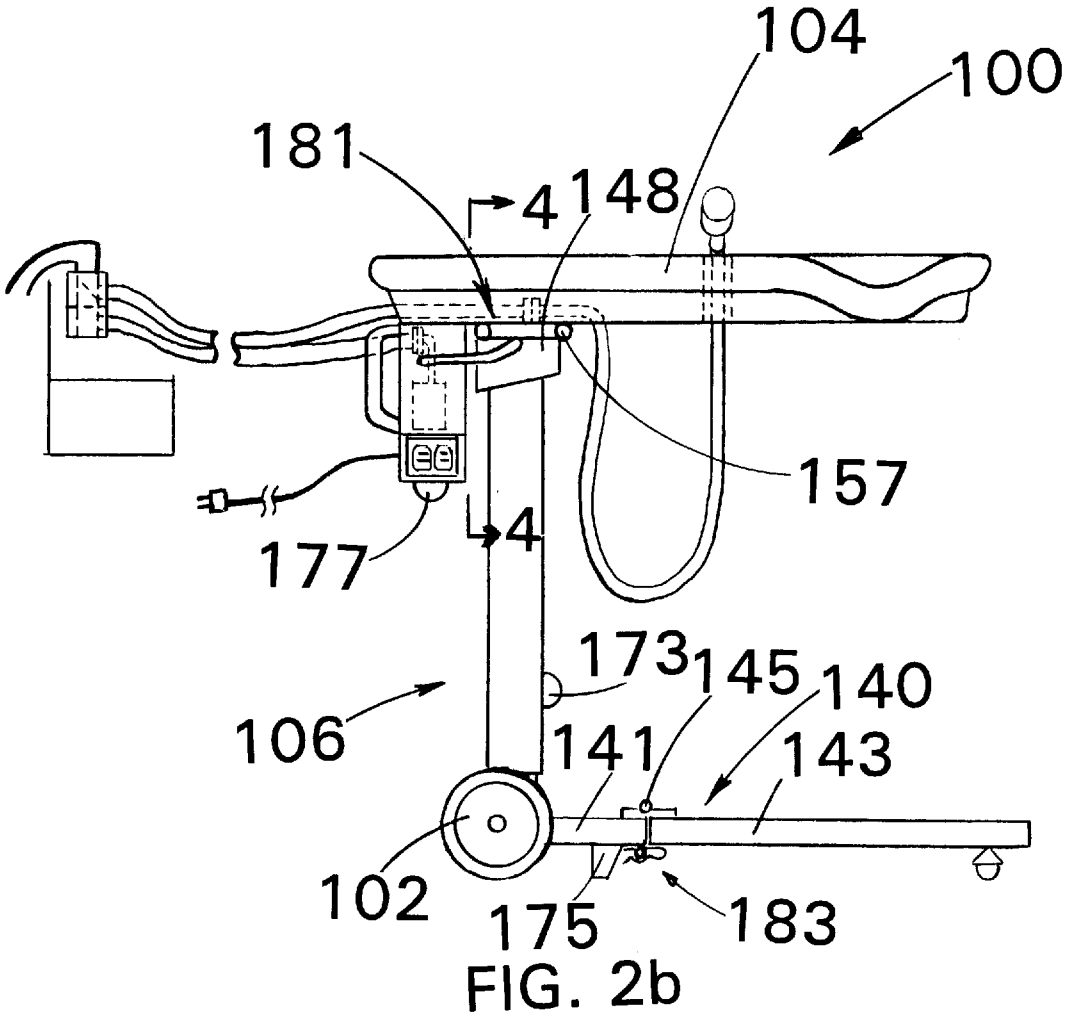
FIG. 2*b* is a side view of the movable washstand wherein an upper horizontal member and lower horizontal member are hinged to allow folding.
Figure 3:
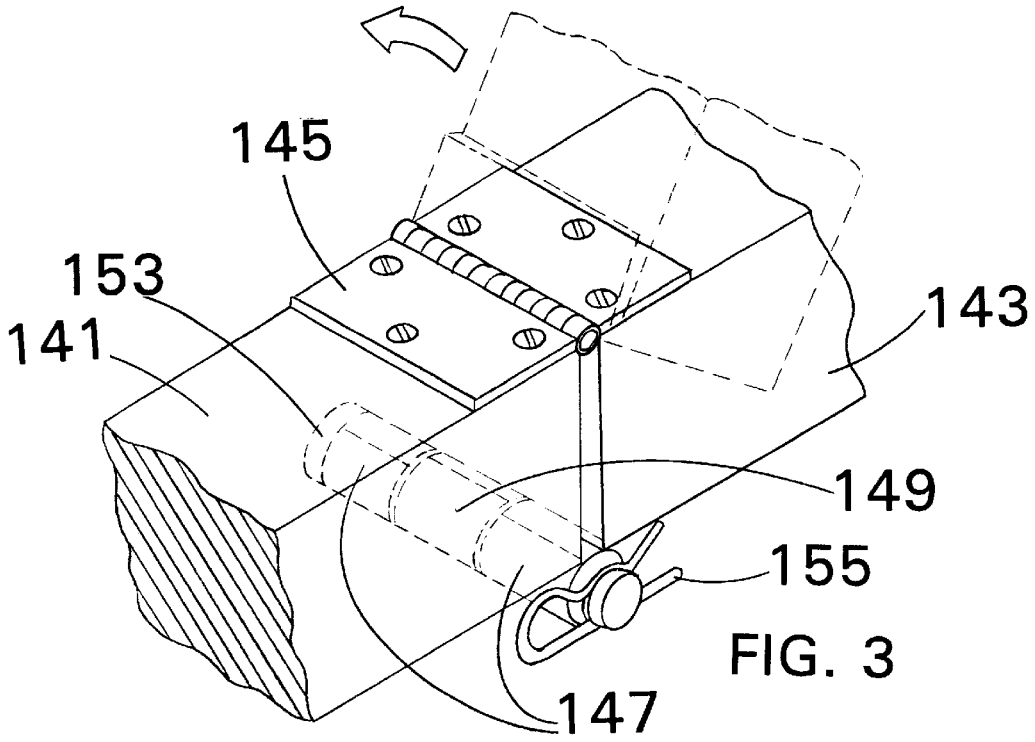
FIG. 3 is a detail drawing showing the hinge and pin connection of the lower horizontal member.

Another movable washstand 100 is depicted in FIG. 2*b*. It includes a large diameter wheel 102 mounted to a C-frame 106, means for folding and locking the catch basin 104 and means for folding and locking a lower horizontal member 140. This lower horizontal member 140 is split into a fixed piece 141 and a folding piece 143. A full length hinge 145 connecting the fixed piece 141 and folding piece 143 is mounted on top of them as shown in FIG. 2*b*. On the underside of the fixed piece 141 are mounted two pin sleeves 147, while on the underside of the folding piece 143 is mounted a pin sleeve 149 (see FIG. 3). When the movable washstand 100 is unfolded, as depicted in FIG. 2*b*, the pin sleeves 147,149 align. Bottom tie pin 151, with a large diameter head 153 at one end, is inserted in pin sleeves 147, 149 to rigidly hold the fixed piece 141 and folding piece 143 in the unfolded configuration shown in FIG. 2*b*. A bottom clevis pin 155 is applied to the bottom tie pin 151 at the end opposite the large diameter head 153, as shown in FIG. 3, to hold the bottom tie pin 151 in the sleeves 147, 149.

Figure 4:
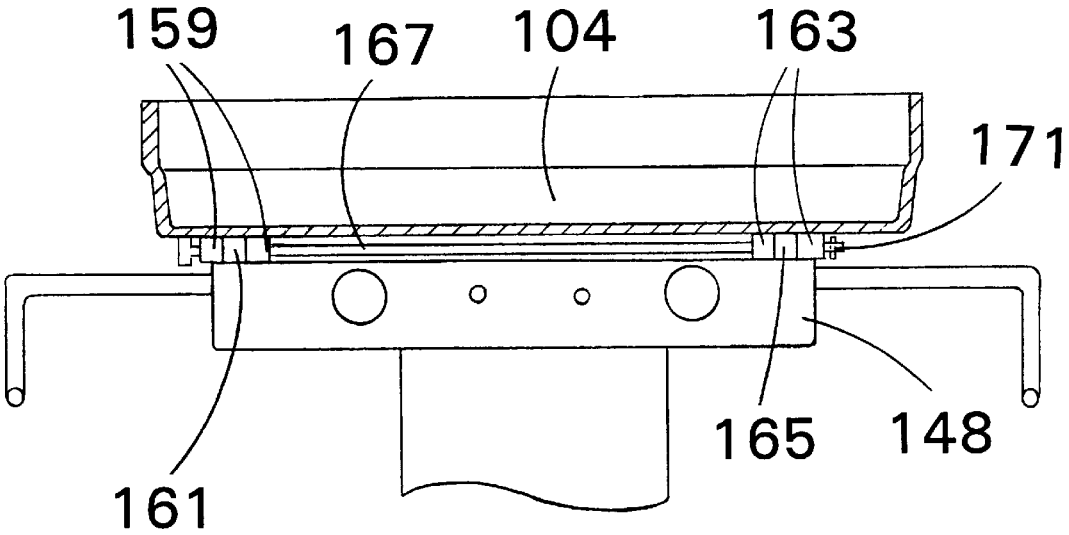
FIG. 4 is a front view of the extended raise/lower handles and the connection of the upper horizontal member taken along lines 4—4 of FIG. 2*b*.

The catch basin 104 is mounted on a hinged pivot 157 and sleeves 159,161,163,165 which are, in the unfolded configuration shown in FIG. 2*b*, all supported on upper horizontal member 148 (see FIG. 4). Outer sleeves 159, 163 are permanently affixed to the upper horizontal member 148, while the middle sleeves 161,165 are permanently affixed to the underside of the catch basin 104. In the unfolded configuration depicted in FIG. 2*b*, all the sleeves 159,161, 163,165 are aligned and top pin 167 inserted therein. A large diameter head 169 prevents the top tie pin 167 from sliding through the sleeves 159,161,163,165 on one end, while a removable top clevis pin 171 applied to the end opposite the large diameter head 169 keeps the top tie pin 167 from sliding through.

Figure 5B:
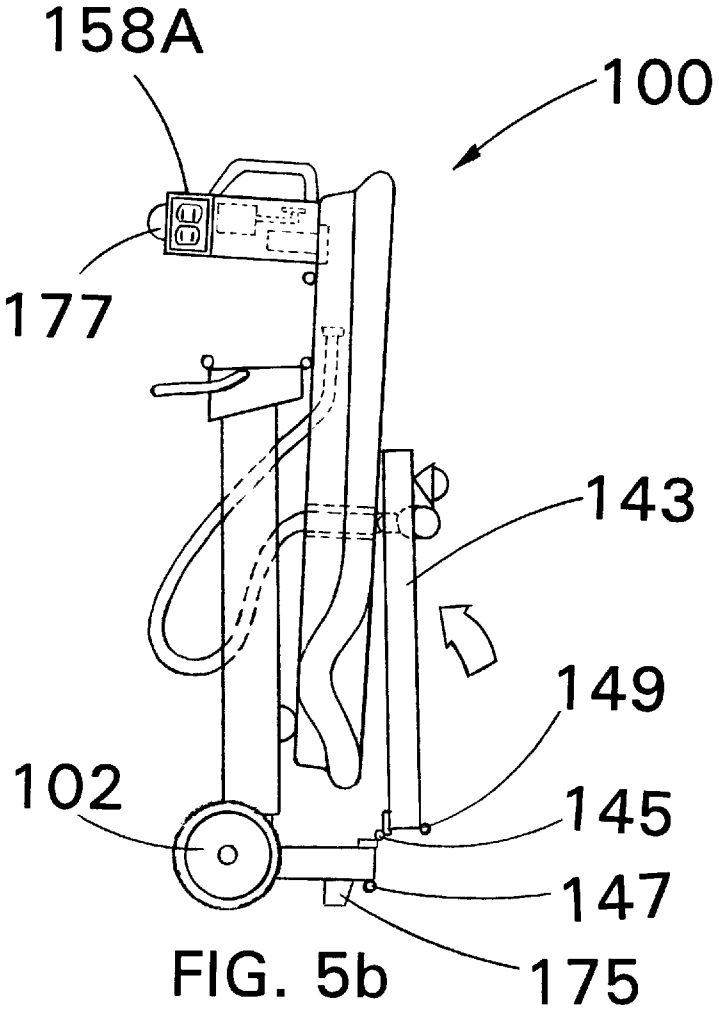
FIG. 5*b* is a side view depicting the second step of folding the movable washstand for portability, folding up the lower horizontal member.
Figure 5A:
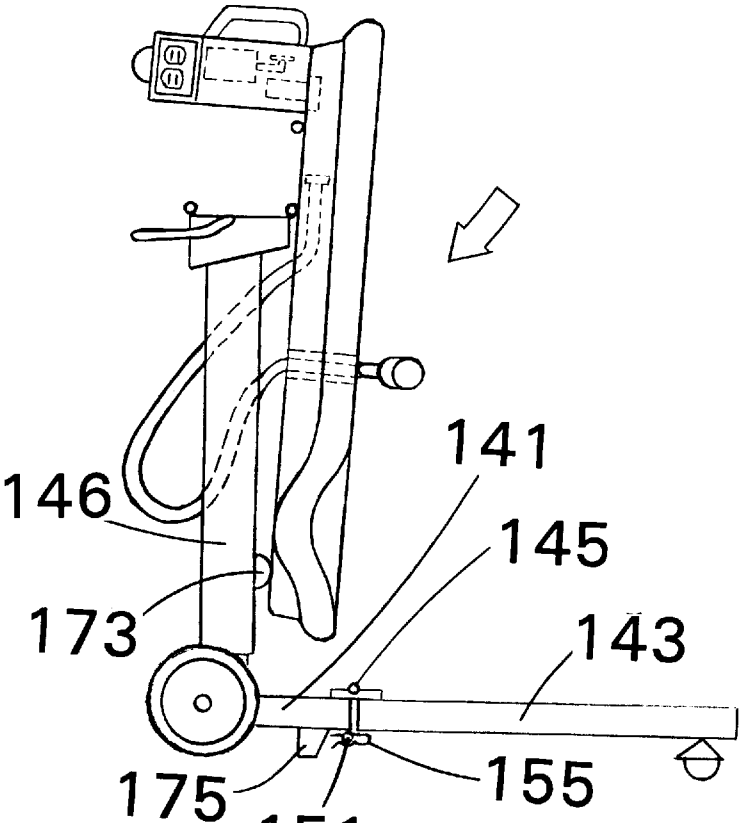
FIG. 5*a* is a side view depicting the first step of folding the movable washstand for portability, folding down the upper horizontal member.

The movable washstand 100 depicted in FIG. 2*b* has folding and locking means, indicated generally at 181,183, to provide a movable washstand that is highly portable and requires minimal storage space. Folding is accomplished by first disengaging the top clevis pin 171 and withdrawing the top tie pin 167 from the sleeves 159,161,163,165. The catch basin 104 then rotates about hinged pivot 157 as indicated by the arrow in FIG. 5*a*. The catch basin 104 is weighted such that it rotates until it comes to rest against rubber bumper 173 mounted on vertical member 146. Next, the bottom clevis pin 155 is removed from bottom tie pin 151, allowing the bottom tie pin 151 to be withdrawn from sleeves 147, 149 (see FIGS. 3 and 5*b*). The folding piece 143 is then rotated about hinge 145, as indicated by the arrow in FIG. 5*b*. The folded movable washstand 100 depicted in FIG. 5*b* is free standing and may be stored vertically, resting on wheel 102 and rubber leg 175, or horizontally, resting on wheel 102 and rubber bumper 177, which is affixed to the bottom side of electrical housing 158A.

Figure 6B:
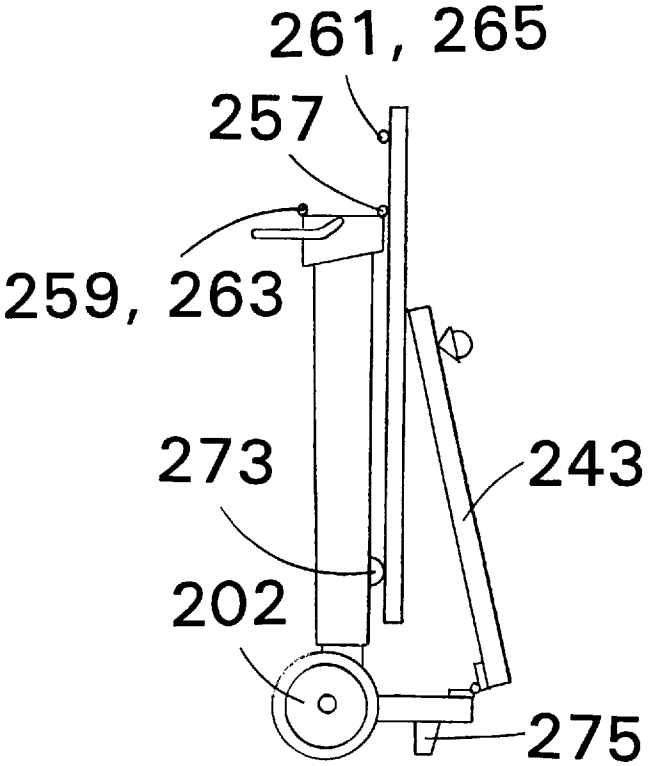
FIG. 6*b* is a side view of the cart shown in FIG. 6*a* in its portable, folded configuration.
Figure 6A:
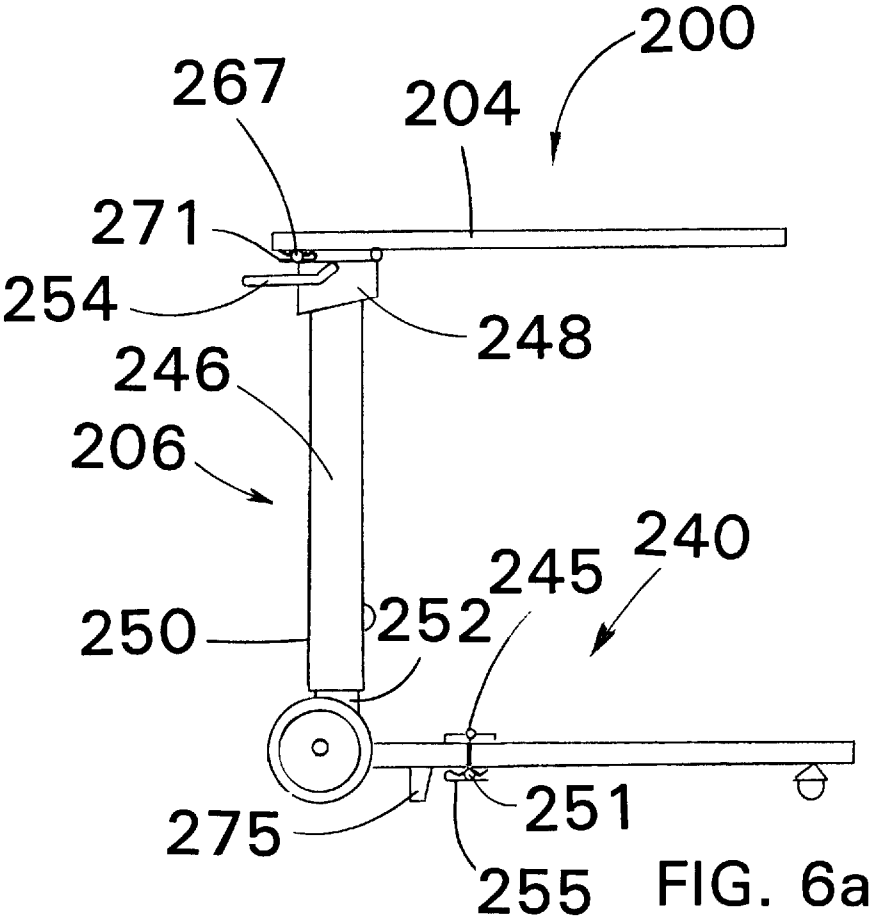
FIG. 6*a* is a side view of a folding cart having height adjustment means and provision for folding the upper horizontal member and lower horizontal member.

A folding cart 200, depicted at FIG. 6*a*, incorporates the folding and locking means illustrated above for the movable washstand 100. A horizontally extending functional surface is provided by a general use table top 204 which replaces the catch basin of the movable washstand 100. The folding cart 200 includes a C-frame 206 having a lower horizontal member 240 which is split into a fixed piece 241 and a folding piece 243, a vertical member 246 and an upper horizontal member 248. The length of the vertical member 248 is adjustable by sliding an outer sleeve 250 over inner post 252. Outer post 250 is locked and latched interiorly to inner post 252 by exteriorly raising and lowering latch handles 254.

The folding cart 200 shown in its folded configuration in FIG. 6*b*, is vertically free standing on wheel 202 and rubber leg 275. Means for folding and locking the folding piece 243 are provide by a hinged pivot 245 and pin sleeves 247, 249 which align in the unfolded configuration shown in FIG. 6*a* to allow insertion of bottom tie pin 151 which is held in place by bottom clevis pin 255. Means for folding and locking the table top 204 are provided by a hinged pivot 257 and sleeves 259,261,263,265 which align in the unfolded configuration shown in FIG. 6*a* to allow insertion of top tie pin 267 which is held in place by to clevis pin 271. Removal of the top clevis pin 271, allows removal of top tie pin 267 which allows the table top 204 to rotate about pivot 257 until it contacts rubber bumper 273.

Figure 7:
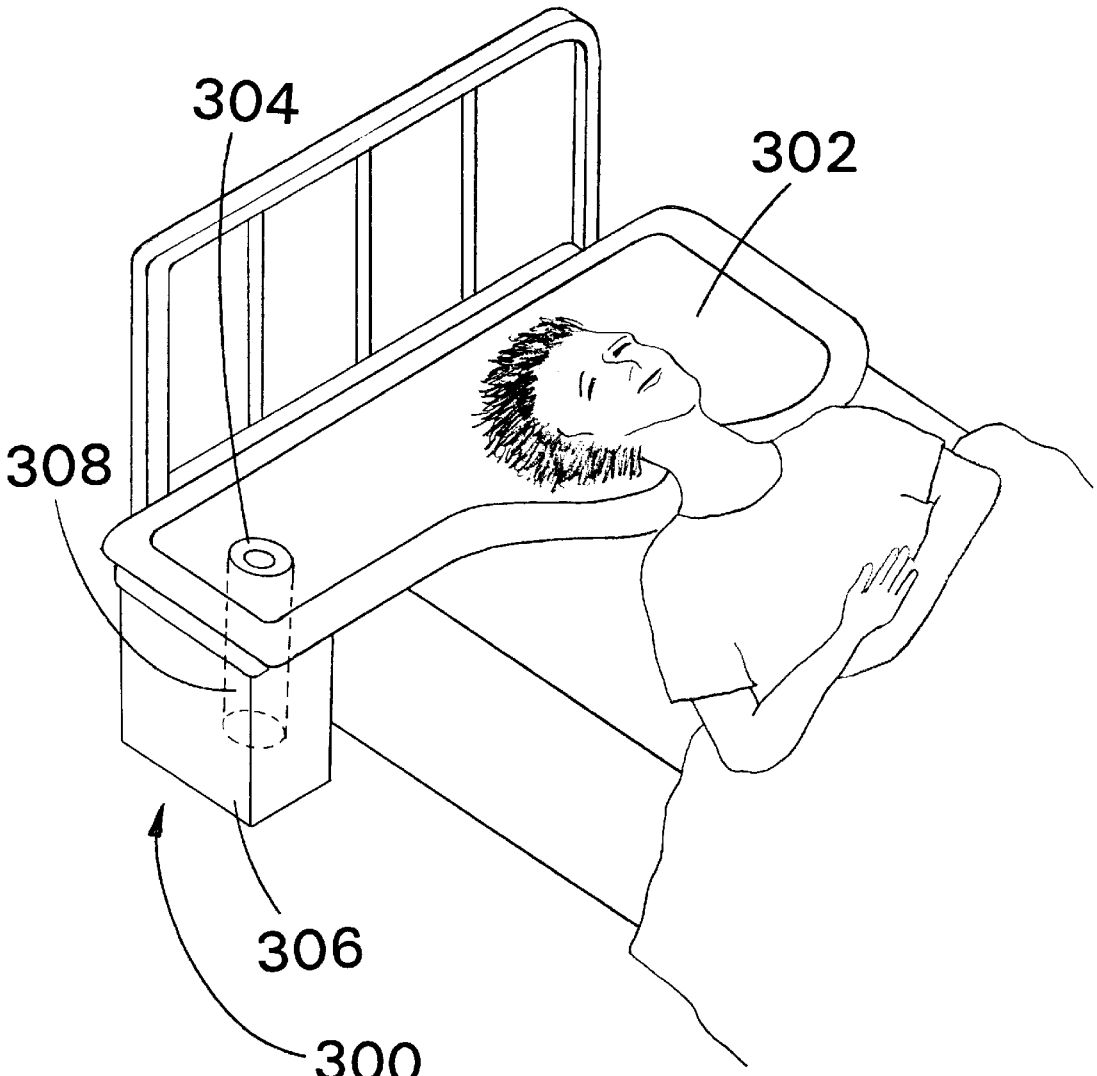
FIG. 7 is a perspective depiction of a self-supported movable wash pan with attached bladder.

Another preferred embodiment of the present invention is the self-supported movable wash pan 300 depicted in FIG. 7. The self-supported movable wash pan 300 has a shallow catch basin 302 so that only minimal movement of a patient's body or head is required to slide the catch basin 302 underneath. Waste water and effluent used in washing a patient is caught in the catch basin 302 and flows toward and through drain 304 and is stored in bladder 306. A discharge pipe 308 provides a means of fluid communication between the drain 304 and bladder 306. The inclusion of the bladder 306 makes it unnecessary to store waste water and effluent in the shallow catch basin 302, so the catch basin 302 can be very shallow. In a preferred embodiment the catch basin is less than 3 inches deep.

We claim:

1. A movable washstand comprising:

a frame having at least one upper horizontal member, at least one lower horizontal member, and at least one vertical member;

a catch basin mounted on said at least one upper horizontal member;

wherein said frame is a C-shaped frame;

wherein said C-frame is mounted on a plurality of wheels comprising multiple wheel assemblies mounted at distal ends and adjacent to said at least one lower horizontal member; and means for folding and locking said upper horizontal member and said lower horizontal member.

2. The movable washstand of claim 1 wherein said folding and locking means comprise hinges and removable pins on both said upper horizontal member and said lower horizontal member.

* * * * *